United States Patent [19]

Kramer

[11] 4,220,247

[45] Sep. 2, 1980

[54] CLOSURE MEMBERS

[76] Inventor: Steven G. Kramer, 60 El Verano Way, San Francisco, Calif. 94127

[21] Appl. No.: 26,839

[22] Filed: Apr. 4, 1979

Related U.S. Application Data

[63] Continuation-in-part of Ser. No. 344, Jan. 2, 1979, abandoned.

[51] Int. Cl.[3] ..... B65D 55/02

[52] U.S. Cl. ..... 215/219; 215/216; 215/220; 116/308; 206/534; 222/153

[58] Field of Search ..... 215/201, 216, 206, 230, 215/219, 220, 365; 116/308; 206/534, 1.5, 539, 459; 222/153

[56] References Cited

U.S. PATENT DOCUMENTS

| | | | |
|---|---|---|---|
| 3,151,599 | 10/1964 | Livingston | 215/230 X |
| 3,888,375 | 6/1975 | Gerk | 215/219 |
| 3,960,713 | 6/1976 | Carey | 206/534 |
| 4,011,829 | 3/1977 | Wachsmann et al. | 116/308 |

*Primary Examiner*—George T. Hall

*Attorney, Agent, or Firm*—Emrich, Root, Lee, Brown & Hill

[57] ABSTRACT

A "reminder-cap" type of closure member for containers, such as medicine bottles, embodying two nested housings which are rotatable relative to each other in one direction, and non-rotatable relative to each other in the other direction, and in which the inner of the two housings has indicia thereon, which is viewable from outside the outer housing, and the outer housing has an indicating portion disposed adjacent to the indicia and movable relative to the later during rotation of the housings relative to each other; and which may embody structure that can be latched and unlatched to afford protection against a small child opening the container closed thereby.

15 Claims, 14 Drawing Figures

CLOSURE MEMBERS

BACKGROUND OF THE INVENTION

This is a continuation-in-part of my co-pending application for United States Letters Patent, Ser. No. 000,344, filed Jan. 2, 1979, and entitled "CLOSURE MEMBERS", now abandoned.

This invention relates to closure members for containers, and, more particularly, to closure members which are particularly well adapted for use on dispensing containers, such as, for example, medicine bottles, and the like.

A primary object of the present invention is to afford a novel closure member for a container.

Another object of the present invention is to afford a novel closure member of the "reminder-cap" type, which embodies indicia that indicates to a person that the container on which it is mounted has been opened a certain number of times or that it is to be, or has been opened at a certain hour, and the like.

Another object of the present invention is to afford a novel container closure member of the "reminder-cap" type, which embodies two members which are rotatable relative to each other into different positions effective to afford the aforementioned indications.

Closure members of the "reminder-cap" type have been heretofore known in the art, being shown, for example, in U.S. Pat. No. 2,644,452, issued July 7, 1953 to F. E. Brown; U.S. Pat. No. 2,767,680, issued Oct. 23, 1956 to H. B. Lermer; U.S. Pat. No. 3,151,599, issued Oct. 6, 1964 to R. J. Livingston; and U.S. Pat. No. 3,960,713, issued June 1, 1976 To H. L. Carey. It is an important object of the present invention to afford improvements over closure members of the type disclosed in the aforementioned patents.

Another object of the present invention is to afford a novel closure member of the "reminder-cap" type, which is rotatable off from and onto the container with which it is used, to thereby open and close the latter, and which embodies indicia for indicating that the container has thus been opened and closed.

An object ancillary to the foregoing is to so constitute and arrange the parts of such a closure member in a novel and expeditious manner relative to each other, such that the parts are substantially automatically advanced one indicating position relative to each other during each closing operation of the closure member to thereby afford an indication of the previous opening of the closure member.

Another object of the present invention is to afford a novel closure member of the "reminder-cap" type, embodying two housings constituted and arranged in a novel and expeditious manner relative to each other with the housings embodying actuating members constituted and arranged in a novel and expeditious manner whereby rotation of one of the housings in one direction is effective to rotate the other housing in the same direction and thereby effect movement of the closure member into open or removed position relative to a container on which it is mounted, and rotation of the one housing in the other direction is effective to yieldingly urge the other housing to rotate in the same aforementioned other direction for rotating the latter into closing position on the container, but wherein continued rotation of the one housing in the aforementioned other direction, after movement of the other housing into fully closed position on the container, is effective to move the actuating members on the two housings relative to each other and thereby move the aforementioned one housing into a new indicating position relative to the other housing.

An object ancillary to the foregoing is to afford a novel closure member of the aforementioned type wherein the housings embody substantially cylindrical-shaped side walls, and the other housing is disposed in the one housing, and the aforementioned actuating members are disposed on the adjacent faces of the side walls of the two housings.

Another object of the present invention is to afford a novel closure member of the "reminder-cap" type, which is sufficiently complicated to operate that when it is mounted in operative position on a container, it is sufficiently difficult for a small child to operate that it affords effective protection against opening of the container by such small children.

A further object of the present invention is to afford a novel "reminder-cap" closure member, which may be latched, in a novel and expeditious manner, to a container on which it is mounted to thereby render it difficult for a small child to open the container and protect against this occurring, while providing a closure member that can be readily opened and closed by the average adult.

Another object of the present invention is to afford a novel closure member of the aforementioned type which is practical and efficient in operation and which may be readily and economically produced commercially.

Other and further objects of the present invention will be apparent from the following description and claims and are illustrated in the accompanying drawings which, by way of illustration, show preferred embodiments of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENTS SHOWN HEREIN

A closure member in the form of a cap 1, embodying the principles of the present invention, is shown in FIGS. 1–6, mounted on the top of a container in the form of a bottle 2, to illustrate the present preferred embodiment of the present invention.

Figure 4:
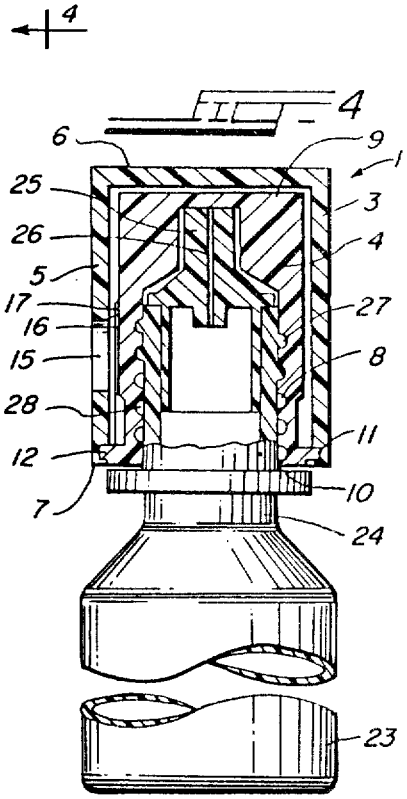
FIG. 4 is a fragmentary, sectional view taken substantially along the line 4—4 in FIG. 1.

The closure member 1 embodies two housings 3 and 4, which in the assembled form of the closure member 1 are disposed in nested relation to each other, as shown in FIG. 4. The outer housing 3 embodies a substantially cylindrical-shaped side wall 5 projecting downwardly from a top wall 6 and terminating at its lower end in an open bottom 7. Similarly, the inner housing 4 embodies a substantially cylindrical-shaped side wall 8 projecting downwardly from a top wall 9 and terminating at its lower end in an open bottom 10. The side wall 5 of the outer housing 3 has an annular recess or groove 11 formed in the inner surface of the lower end portion thereof, and the side wall 8 of the inner housing 4 has an annular flange 12, which is complementary in size and shape to the annular groove 11, extending around and projecting outwardly from the lower end portion of the side wall 8. In the assembled cap 1, the inner housing 4 is disposed in the outer housing 3 with the top walls 6 and 9 disposed in closely adjacent relation to each other, and with the flange 12 on the inner housing 4 disposed in the recess 11 in the outer housing 3 with a relatively snug, but freely slidable frictional fit. As will be discussed in greater detail presently, the housings 3 and 4 are rotatable relative to each other around the longitudinal axes thereof.

Figure 1:
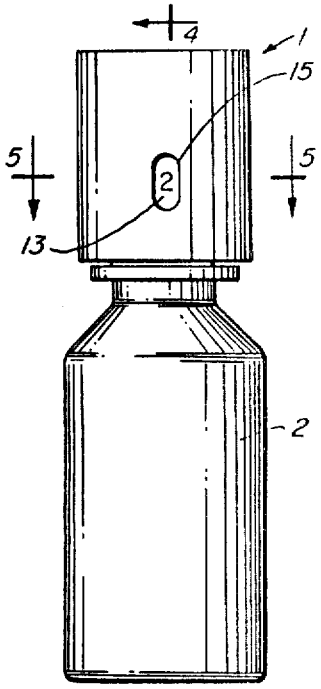
FIG. 1 is a side elevational view of a closure member embodying the principles of the present invention, and showing the closure member mounted on a container in closing relation thereto.
Figure 2:
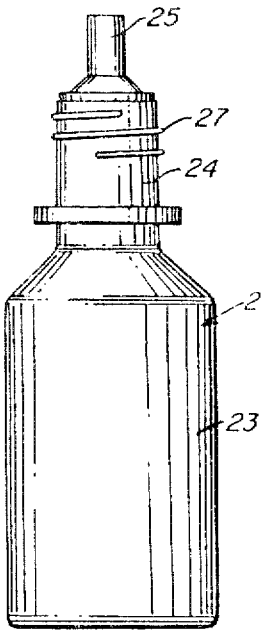
FIG. 2 is a side elevational view of the container shown in FIG. 1.
Figure 3:
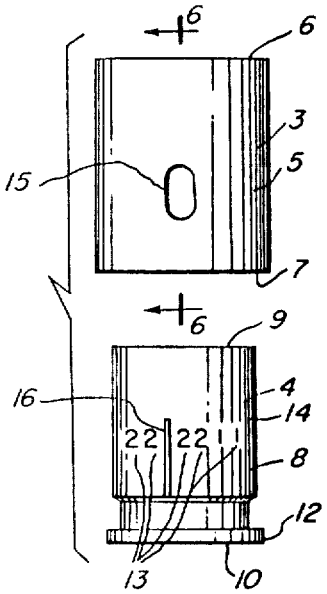
FIG. 3 is an exploded, side elevational view of the closure member shown in FIG. 1.

The inner housing 4 has a plurality of indicia 13, FIGS. 1 and 3, spaced around the outer surfaces 14 of the side wall 8 thereof in uniplanar relation to each other, and in upwardly spaced, substantially parallel relation to the open bottom 10. The outer housing 3 of the closure member 1 has an indicating portion 15, in the form of a sight opening or aperture 15 extending through one side thereof, FIGS. 1, 3 and 4, in such position that it is disposed in uniplanar relation to the indicia 13 in the assembled closure member 1, so that the position of the indicating portion 15 relative to the indicia 13 may be determined by viewing the indicia 13 through the aperture 15 from outside of the housing 3 during the aforementioned rotation of the housings 3 and 4 relative to each other.

Figure 5:
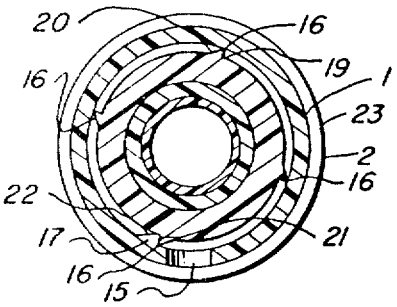
FIG. 5 is a detail sectional view taken substantially along the line 5—5 in FIG. 1.
Figure 6:
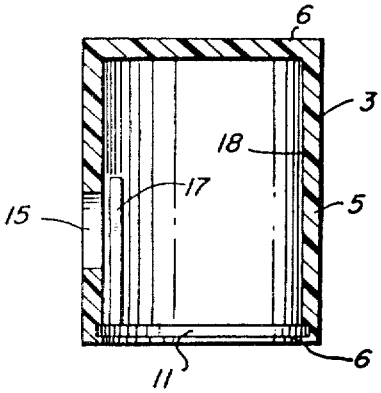
FIG. 6 is a detail sectional view taken substantially along the line 6—6 in FIG. 3.

The inner housing 4 has a plurality of external abutment members 16, FIG. 5, in the form of elongated ribs, FIG. 3, formed on and projecting outwardly from the external surface 14 of the side wall 8 thereof in substantially parallel, spaced relation to each other and to the longitudinal axis of the housing 4.

The outer housing 3 has a single internal abutment member 17, FIG. 5, in the form of an elongated rib, FIG, 6, formed on and projecting inwardly from the internal surface 18 of the side wall 5 thereof in substantially parallel, spaced relation to the longitudinal axis of the housing 3.

The ribs 16 are spaced upwardly from the bottom 10 of the side wall 8, FIG. 3, and terminate at their upper ends in downwardly spaced relation to the top wall 9 of the inner housing 4. The rib 17 on the outer housing 3 projects upwardly from the recess 11 in the lower end portion of the side wall 5 thereof and terminates in downwardly spaced relation to the top wall 6 of the housing 3, FIG. 6. The rib 17 is of such length that, when the housings 3 and 4 are disposed in assembled relation to each other, it projects upwardly beyond the upper ends of the ribs 16, FIG. 4.

Each of the ribs 16 embodies one side face 19, which is substantially perpendicular to the outer surface 14 of the inner housing 4, and another side face 20 sloping inwardly from the outer edge of the face 19 at an inwardly opening acute angle, relative to the housing 4, FIG. 5. Similarly, the rib 17 has one side face 21 which projects inwardly from the inner surface 18 of the side wall 5 of the outer housing 3 in substantially perpendicular relation thereto, and another side face 22, which projects outwardly from the inner edge of the side face 21 at an outwardly opening acute angle, relative to the housing 3, FIG. 5.

The faces 19 and 20 on the rib 16, and the faces 21 and 22 on the rib 17 are so disposed on the housing 4 and 3, respectively, that the faces 19 and 21 are disposed in facing relation to each other, and the faces 20 and 22 are disposed in facing relation to each other. With this construction, when the outer housing 3 is rotated in a counter clockwise direction, as viewed in FIG. 5, relative to the inner housing 4, the face 21 on the rib 17 is moved into abutting engagement with the face 19 on the rib 16 which is disposed in next adjacent relation to the rib 17 in the direction of rotation of the housing 3. When this occurs, a firm, unyielding, abutting engagement is effected between the face 21 of the rib 17 and the face 19 of the rib 16 which is so engaged by the face 21, and continued rotation of the outer housing 3 in the aforementioned counter clockwise direction, as viewed in FIG. 5, is effective to apply a strong rotating force, in the same direction, to the inner housing 4.

On the other hand, with the aforementioned construction, when the outer housing 3 is rotated in a clockwise direction, as viewed in FIG. 5, relative to the inner housing 4, the sloping face 22 of the rib 17 on the outer housing 13 is moved into engagement with the sloping face 20 on the rib 16 of the inner housing 4, which is next adjacent in the aforementioned direction of rotation of the outer housing 3. When this occurs, a yielding, frictional engagement is effected between the engaged faces 20 and 22. The housings 3 and 4 are made of a suitable, resilient material, such as, for example, a suitable plastic material such as polypropylene, and the side wall 5 and rib 17 of the outer housing 3 and the side wall 8 and ribs 16 of the inner housing 4 are of such thickness that the wedging engagement effected between the aforementioned engaged faces 20 and 22 is effective to spread the side walls 5 and 8 relative to each other a sufficient distance to permit the rib 17 to move past the engaged rib 16 into the space between the latter and the next adjacent rib 16, in the aforementioned direction of rotation of the outer housing 3. Preferably, the ribs 16 and 17 are of such size, and the side walls 5 and 8 are of such resiliency that although the aforementioned engagement between the faces 20 and 22 is noticeable to a person rotating the housing 3 relative to the housing 4, so as to afford an indication to the person that an indexing movement to the next position is occurring, continued rotation of the housing 3 relative to the housing 4 in the aforementioned clockwise direction may be effected with substantially no difficulty.

With this construction of the closure member 1, it will be seen that the housings 3 and 4 are so constituted and arranged relative to each other that the closure member or cap 1 may be removed from a suitable container, such as the bottle 2, by rotating the outer housing 3 in a counter clockwise direction, as viewed in FIG. 5, to thereby engage the face 21 of the rib 17 with the face 19 of one of the ribs 16 and thus rotate the inner housing 4 in the same direction, which is effective to unscrew the cap 1 from the bottle 2; and when the cap 1 is to again be mounted on the bottle 2 in closing relation thereto, the outer housing 3 may be rotated in a clockwise direction, as viewed in FIG. 5, to thereby afford a frictional driving force between the face 22 of the rib 17 and the face 20 of the rib 16 engaged thereby in a direction to similarly turn the inner housing 4 and thus screw it back on into closed position on the bottle 2, until the cap 1 is disposed in fully closed position relative to the container 2. When the cap 1 is disposed in fully closed position on the bottle 2, continued rotation of the housing 3 in the aforementioned clockwise direction, will cause the rib 17 to slip past the engaged rib 16 and thus advance the aperture 15 in a clockwise direction, as viewed in FIG. 5, to the next indexed position relative to the indicia 13 on the inner housing 4.

The bottle 2, shown in the drawings, is of a so-called "dispensing" type, which is particularly well adapted for dispensing eye drops, or the like, and embodies a body portion 23 having a narrow neck 24 at the upper end thereof, with a plug 25 mounted in the upper end portion of the neck 24 and having an orifice or passageway 26 extending vertically therethrough, FIG. 4. The bottle 2 has external threads 27 on the neck 24, FIG. 2, and corresponding internal threads 28 are formed in the side wall 8 of the inner housing 4, FIG. 4, for engagement with the threads 27. In the closed position of the cap 1 on the bottle 2, as shown in FIG. 4, the top wall 9 of the inner housing 4 rests on top of the plug 25 in the bottle 2, to thereby prevent further rotation of the inner housing 4 in a clockwise direction, as viewed in FIG. 5. When this occurs, continued forcing of the outer housing 3 toward a bottle-closing direction will cause the rib 17 to snap over the engaged rib 16 and thereby signal the person closing the bottle that it is fully closed and, substantially automatically, move the outer housing 3 to the next position relative to the ribs 16 in each closing operation of the cap 1. This moves the aperture 15 into position wherein the indicia 13 visible therethrough is on a different portion of the inner housing 14 than was true prior to the rib 17 moving past the engaged rib 16. Preferably, when the rib 17 snaps past the engaged rib 16 in the aforementioned manner, it does so not only in a manner that it can be felt by the person operating the cap, but with an audible "click" so as to, also, audibly signal the operator.

The indicia 13, shown in the drawings, constitutes sequential numbers, such as the numerals "1" and "2" visible in FIG. 3. With this construction, the various or different types of numerals may be so positioned on the outer surface 14 of the side wall 8 of the inner housing 4 that when the rib 17 is disposed between a certain pair of the ribs 16, only the numeral "1" is visible through the aperture 15, and as the rib 17 advances, in a clockwise direction, as viewed in FIG. 5, from between one pair of adjacent ribs 16 to the other the next numeral, such as the numerals "2", "3" and "4" are sequentially visible through the aperture 15 during a complete revolution of the outer housing 3 relative to the inner housing 4.

As will be appreciated by those skilled in the art, although the cap 1 shown in the drawings embodies only four pairs of adjacent ribs 16, and the indicia 13 constitutes sequential numbers, this is merely by way of illustration of the preferred embodiment of the present invention, and not by way of limitation, and a different number of ribs 16, and different forms of indicia 13 may be used without departing from the purview of the broader aspects of the present invention. For example, rather than having the four numerals for indicating that the bottle has been opened the first, second, third etc. time for the application of eye drops, or the taking of pills, or the like, the cap 1 might embody twelve ribs 16 with the numerals one to twelve being disposed between adjacent pairs of the ribs 16, to indicate the hours of the day, so that after each time the container 2 is opened, the outer housing 3 could be advanced relative to the inner housing 4 into position to see the next hour, through the aperture 15, indicating the time that the medication was next to be taken, or the cap 1 might embody seven ribs 16 with the different days of the week being disposed between respective pairs of ribs for use in keeping track of one-a-day taking or application of medication, and the like.

Figure 7:
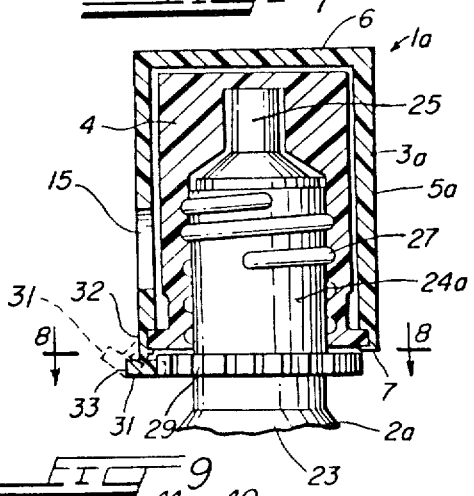
FIG. 7 is a view similar to FIG. 4, but showing a modified form of the present invention.
Figure 8:
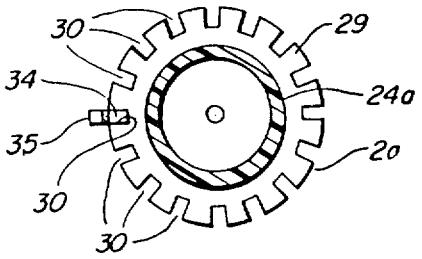
FIG. 8 is a detail sectional view taken substantially along the line 8—8 in FIG. 7.

In FIGS. 7–8 of the drawings, a modified form of the present invention is shown, and parts which are the same as parts shown in FIGS. 1–6 are indicated by the same reference numerals, and parts which are similar to parts shown in FIGS. 1–6, but differ therefrom, are indicated by the same reference numerals with the suffix "a" added thereto.

The bottle **2*a* shown in FIGS. 7–8 is the same in construction as the bottle 2 shown in FIGS. 1–6 except that it embodies an outwardly projecting, annular flange 29, having a plurality of notches or recesses 30 formed in and spaced around the outer periphery thereof, with the flange 29 being disposed in such position on the neck 24*a* that it is disposed in closely adjacent, spaced relation below the lower end of the inner housing 4 of the closure member or cap 1*a* when the latter is disposed in fully closed position on the bottle 2*a***.

Similarly, the cap **1*a* is the same in construction as the cap 1, except that a flexible, resilient tab 31 projects downwardly from the side wall 5*a*, FIG. 7. The tab 31 shown in the drawings is of substantially inverted T-shape having a shank or body portion 32 projecting downwardly beyond the inner housing 4, and a cross bar or head portion 33 projecting outwardly in opposite directions from the body portion 32. Preferably, the tab member 31 is formed integrally with the side wall 5*a* of the outer housing 3*a***.

The cross bar 33 of the tab 31 is of such size that, when it is disposed directly opposite one of notches 30, and the tab 31 is disposed in its normal at-rest position, one end portion 34 of the cross bar 33 is disposed in the one notch 30, and the other end portion 35 of the cross bar 33 projects radially outwardly therefrom, FIG. 8.

Preferably, the cross bar 31 is of such size that, when it is disposed in the aforementioned normal, at-rest position, the end portion 35 projects radially outwardly beyond the remainder of the side wall portion 5a of the outer housing 3a, as shown in solid lines in FIG. 7.

With this construction, when the tab 31 is thus operatively engaged in one of the notches 30, it affords an effective latch for preventing rotation of the cap 1a relative to the bottle 2a. However, the tab 31 is sufficiently flexible that it may be manually bent outwardly, by the average adult, into a position, such as shown in broken lines in FIG. 7, relative to the remainder of the outer housing 3a, effective to withdraw the cross bar 33 from engagement with the previously engaged notch 30 and thereby free the cap 1a for rotation in a counter clockwise direction, as viewed in FIG. 8, to thereby remove the cap 1a from the bottle 2a. However, with this construction, it will be seen that it is difficult, if not impossible, for a small child to remove the cap 1a from the bottle 2a, because, not only must the child be able to bend the tab 31 into outwardly projecting position, to free it from the notch 30 with which it was engaged, but the child must continue to hold the tab 31 in such outwardly projecting position during the removal of the cap 1a from the bottle 2a, or it will again snap back into latching position relative to one of the other notches 30.

Thus, it will be seen that, with the closure and container construction shown in FIGS. 7-8, effective protection against opening of the container 2a by a child, after the closure member 1a has been disposed in fully closed position relative to the container 2a, is afforded.

Also, it will be seen that the same "reminder-cap" features are afforded in the clousre member 1a, shown in FIGS. 7-8, as are embodied in the closure member 1a, shown in FIGS. 1-6, the outer housing 3a being the same in construction as the housing 3 of the closure member 1, except for the addition of the tab member 31, and the arrangement of the outer housing 3a and the inner housing 4 of the closure member 1a, relative to each other, being the same as that of the outer housing 3 and the inner housing 4 of the closure member 1.

Figure 9:
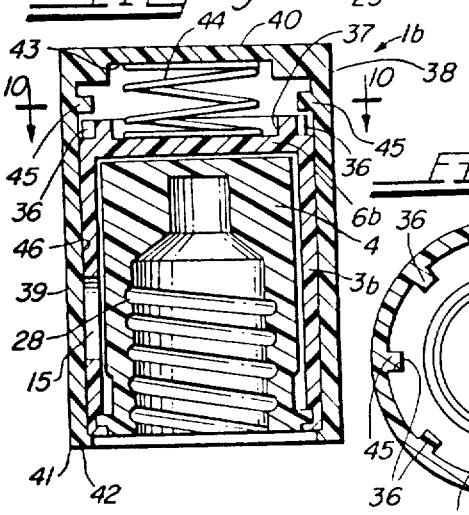
FIG. 9 is a detail sectional view, similar to FIG. 4, through a closure member, but illustrating another modified form of the present invention.
Figure 10:
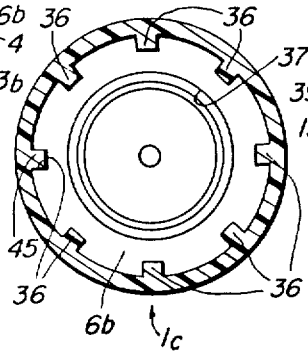
FIG. 10 is a detail sectional view taken substantially along the line 10—10 in FIG. 9.
Figure 11:
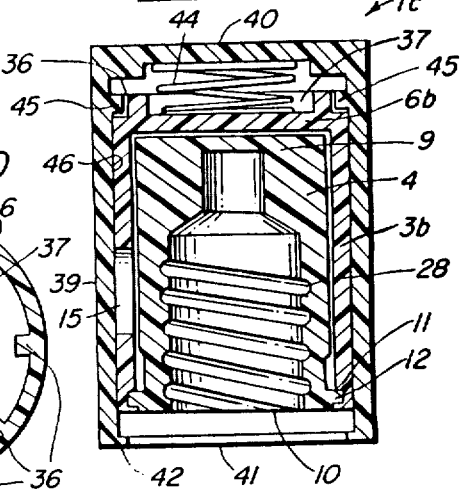
FIG. 11 is a detail sectional view, similar to FIG. 9, but showing the parts of the closure member in different operative position relative to each other.

In FIGS. 9-11 of the drawings, another modified form of the present invention is shown, and parts which are the same as parts shown in FIGS. 1-6 are indicated by the same reference numeral, and parts which are similar to parts shown in FIGS. 1-6, but differ therefrom, are indicated by the same reference numerals with the suffix "b" added thereto.

The closure member 1b, shown in FIGS. 9-11, embodies an inner housing 4 which is identical in construction to the housing 4 shown in FIGS. 1-6. The closure member 1b also embodies an outer housing 3b which is the same in construction as the outer housing 3 shown in FIGS. 1-6, except that the outer housing 3b has a plurality of notches 36 formed in the outer, upper peripheral edge of the top wall 6b thereof, FIGS. 9 and 10, respective pairs of such notches 36 being disposed diametrically opposite each other, FIG. 10; and the top wall 6b embodies a centrally disposed recess 37 in the upper face thereof, FIGS. 9 and 10. In all other respects, the housings 3b and 4 are of the same construction, and are arranged relative to each other in the same manner as that of the housings 3 and 4, shown in FIGS. 1-6.

In addition to the housings 3b and 4, the closure member 1b embodies another housing 38, which, like the housings 3b and 4, embodies a substantially cylindrical-shaped side wall 39 projecting downwardly from a top wall 40, and terminating at its lower end in an open bottom 41. The side wall 39 embodies an inwardly projecting annular flange 42 at the lower end portion thereof, the upper face of the flange 42 being disposed downwardly from the lower face of the top wall 40 a greater distance than the vertical length of the housing 3b, FIG. 9.

In the assembled closure member 1b, the housing 3b is disposed in the housing 38 with a relatively snug, but freely slidable fit, and rests on the upper face of the flange 42. Like the housings 3 and 4 of the closure member 1, shown in FIGS. 1-6, the housing 38 is made of a suitable, flexible, resilient material, such as, for example, the aforementioned polypropylene, and, in assembling the closure member 1b, the housing 3b, with the housing 4 disposed therein, may be pressed upwardly through the open bottom 41 of the side wall 39, the lower end portion of the side wall 39 flexing outwardly sufficiently to permit such entry of the housing 3b thereinto, and the resilience of the side wall 39 being such that it will then move the flange 42 back into retaining position relative to the housing 39.

The top wall 40 of the housing 38 has a centrally disposed recess 43 in the lower face thereof, which is of the same size as the recess 37 in the top wall 6b of the housing 3b, and in the assembled closure member 1b, the recesses 37 and 43 are disposed in axial alignment with each other. In assembling the closure member 1b, a compression coil spring 44 is disposed in the recess 37 in the housing 3b, prior to the insertion of the housings 3b and 4 into the housing 38, the spring 44 being of such size that, in the assembled closure member 1b, the opposite ends thereof are disposed in the recesses 37 and 43, and the spring 44 is effective to yieldingly urge the housing 3b into abutting engagement with the upper face of the flange 42 on the housing 38, as shown in FIG. 9, when the housings 3b and 38 are disposed in normal at-rest position relative to each other.

The housing 38 has two abutment members 45 projecting inwardly from the inner surface 46 of the side wall 39 thereof in diametrically opposed relation to each other. The abutment members 45 are complementary in size and shape to the notches 36 in the top wall 6b of the housing 3b, and are so disposed on the side wall 39 that, when the housing 38 is disposed in abutting engagement with the upper face of the flange 42, the abutment members 45 are disposed in upwardly spaced relation to the top wall 6b of the housing 3b, as shown in FIG. 9. In this position of the housing 38 relative to the housing 3b, it is freely rotatable around the common longitudinal axis of the two housings. Preferably, the housing 38 is made from a suitable clear, transparent plastic, such as the aforementioned polypropylene, so that the indicia on the housing 4 of the closure member 1b may be viewed through the aperture 15 in the housing 3b through the side wall 39 of the housing 38.

When it is desired to rotate the housing 3b relative to the housing 4, or to simultaneously rotate the housings 3b and 4, the housing 38 may be manually pressed downwardly relative to the housing 3b, against the urging of the spring 44, into position, as shown in FIG. 11, wherein the abutment members 45 are engaged in diametrically opposed notches 36. In this position, rotation of the housing 38 around the longitudinal axis thereof is effective to correspondingly rotate the housing 3b. Thus, such rotation of the housing 38 is effective to rotate the housings 3b and 4 together, or relative to each other in the same manner as heretofore discussed with respect to the housings 3 and 4 of the closure member 1, shown in FIGS. 1-6, and their is no danger that the manual pressure placed on the cap 1*b*, axially thereof, will cause binding of the "reminder-cap" portion thereof during rotation of the housing 3*b* relative to the housing 4 into a new indexed position. When the housing 38 is manually released, the spring 44 is effective to again move it outwardly into the position shown in FIG. 9, wherein the abutment members 45 are disposed in upwardly spaced relation to the housing 3*b* and, therefore, are ineffective to rotate the latter.

It will be seen that with this construction of the present invention, highly effective protection is afforded against a small child rotating the housings 3*b* and 4 in a manner to remove them from a fully closed position on a container, such as the bottle 2, shown in FIGS. 1-6. To do this, the child would have to not only first move the housing 38 axially into position to engage the abutment members 45 in notches 36 and then rotate the housing 38, but the child would have to continue to so hold the housing 38 in such effective position, against the urging of the spring 44, during the entire rotation of the housings 3*b* and 4, necessary to remove them from the container that had been closed thereby.

It will be seen that insofar as the housings 3*b* and 4, themselves, are concerned, they are operable together, and relative to each other in the same manner as the housings 3 and 4 of the closure member 1, shown in FIGS. 1-6, and that the closure member 1*b*, like the closure member 1 affords an effective "remainder-cap" type of closure member.

Figure 12:
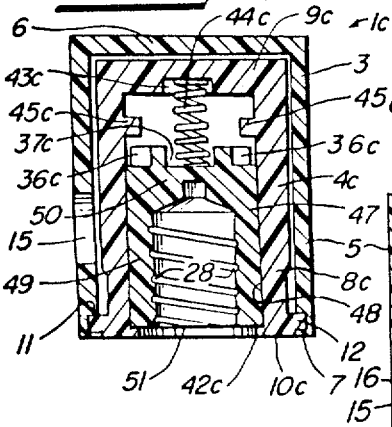
FIG. 12 is a detail sectional view, similar to FIG. 9, but showing another modified form of the present invention.
Figure 13:
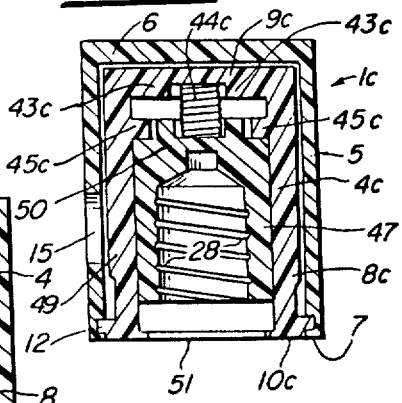
FIG. 13 is a sectional view, similar to FIG. 12, but showing the parts of the closure member in different operative position relative to each other.

Another modified form of the present invention is shown in FIGS. 12-13, which, in some respects is merely the reverse of the closure 1*b*, shown in FIGS. 9-11, as will be discussed in greater detail presently; and parts which are the same as parts shown in FIGS. 1-6 are indicated by the same reference numerals, and parts which are similar to parts shown in FIGS. 1-6, but differ therefrom, are shown by the same reference numerals with the suffix "c" added thereto. Also, in FIGS. 12-13, parts which are similar to parts shown in FIGS. 9-11, but differ therefrom, are indicated by the same reference numerals with the suffix "c" added thereto.

The closure member 1*c* is similar in construction to the closure member 1*b* shown in FIGS. 9-11, except, in the closure member 1*c* a housing 47 is disposed inside a "reminder-cap" type of assembly rather than a housing being disposed on the outside thereof, as shown in FIGS. 9-11, as will be discussed in greater detail presently.

The closure member or cap 1*c*, shown in FIGS. 12-13, embodies a housing 4*c* mounted in a housing 3. The housing 3 of the closure member 1*c* is the same in construction as the housing 3 of the closure member 1, shown in FIGS. 1-6, and the housing 4*c* of the closure member 1*c* is the same in construction as the housing 4 of the closure member 1, except for the interior thereof. In the housing 4*c*, instead of the side wall 8*c* being internally threaded and adapted to be mounted directly on the top of a closure member, such as, for example, the closure member 2 shown in FIGS. 1-6, the side wall 8*c* has a substantially cylindrical-shaped opening 48 therein, which is adapted to receive the housing 47. Like the housings 3 and 4, shown in FIGS. 1-6, the housing 47 embodies a substantially cylindrical-shaped side wall 49 projecting downwardly from a top wall 50, and terminating at its lower end in an open bottom 51. Like the inner cap 4 of the closure member 1, the housing 47 of the cap 1*c* is internally threaded for mounting on the upper end of a container, such as the bottle 2, shown in FIGS. 1-6. Like the housing 3*b* of the closure member 1*b*, shown in FIGS. 9-11, the housing 47 has a plurality of notches or recesses 36*c* formed in the upper, outer periphery of the top wall 50 thereof, and has a central opening 37*c* in the top of the top wall 50. Like the assembly of the housings 3*b* and 4 of the closure member 1*b*, the housing 47 is adapted to rest on a flange 42*c* in the lower end portion of the adjacent housing 4*c*, when the closure member 1*c* is disposed in assembled, normal, at-rest position.

Also, like the housing 38 of the closure member 1*b*, shown in FIGS. 9-11, the housing 4*c* of the closure member 1*c* embodies two inwardly projecting abutment members 45*c* disposed diametrically opposite each other and a central opening 43*c* in the lower face of the top wall 9*c* thereof. As in the closure member 1*b*, a compression coil spring 44*c* is disposed between the recesses 37*c* and 43*c*, and is effective to normally urge the housing 47 into abutting engagement with the top of the flange 42*c*.

With this construction, in order to rotate the housing 47 in the aforementioned counter clockwise direction of the closure members 1-1*b*, effective to remove the closure member 1*c* from a container, the assembly of the housing 3 and the housing 4*c* must first be depressed against the urging of the spring 44*c* into position to engage the abutment members 45*c* in a pair of diametrically opposed openings 36*c*, as shown in FIG. 13. In the raised position of the assembly of the housings 3 and 4*c*, the latter may freely rotate on the housing 47, around the longitudinal axis thereof, and is ineffective to move the housing 47.

Thus, like the closure member 1*b*, the closure member 1*c* affords effective protection against a small child being able to remove the closure member 1*c* from fully closed position on a container, such as the container 2, shown in FIGS. 1-6.

It will be seen that insofar as the housings 3 and 4*c*, themselves, are concerned, they are operable together, and relative to each other in the same manner as the housings 3 and 4 of the closure member 1, shown in FIGS. 1-6, and that the closure member 1*c*, like the closure member 1 affords an effective "reminder-cap" type of closure member.

Figure 14:
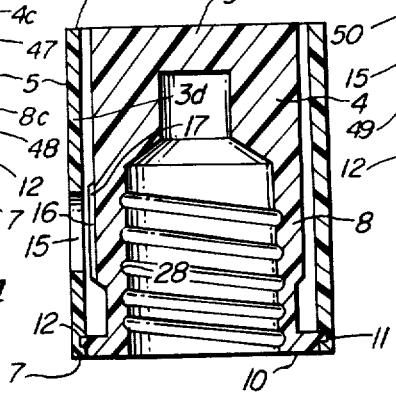
FIG. 14 is a sectional view, similar to FIG. 4, through a closure member, but illustrating another modified form of the present invention.

In FIG. 14 of the drawings, another modified form of the present invention is shown, and parts which are the same as parts shown in FIGS. 1-6 are indicated by the same reference numerals, and parts which are similar to parts shown in FIGS. 1-6, but differ therefrom, are indicated by the same reference numerals with the suffix "d" added thereto.

The cap 1*d* is the same in construction as the cap 1, shown in FIGS. 1-6, except that the outer housing 3*d* does not have any top wall, and the cylindrical-shaped side wall 5 thereof is open at its upper end 52, as well as at its bottom 7. The upper end 52 of the side wall 5 is shown in the drawings disposed in uniplanar relation to the upper side of the top wall 9 of the inner housing 4. However, as will be appreciated by those skilled in the art, this is merely by way of illustration of the preferred form of the present invention and not by way of limitation as to the broader aspects thereof. The primary purpose of so constructing the outer wall 5 is to prevent a person grasping a sufficiently large portion of the side wall 8 of the inner housing 4 in a manner whereby the latter could be unintentionally rotated without correspondingly rotating the outer housing 3*d*. For this purpose, of course, it is not necessary that the upper end 52 of the side wall 5 be disposed in uniplanar relation to the upper side of the top wall 9, but only that it not be disposed below that level a sufficient amount to permit the upper end of the inner housing 4 to be so grasped.

Also, like the housing 3 shown in FIG. 4, the housing 3*d* of the cap 1*d* embodies an aperture 15 in the side wall 5 thereof. Like the aperture 15 in the cap 1, shown in FIG. 4, it forms the preferred form of an indicating portion on the outer housing 3*d* but, as will be appreciated by those skilled in the art, this is merely by way of illustration of the preferred form of the present invention and not by way of limitation, and other forms of indicating portions, such as, for example, a mark applied to a transparent form of the side wall 5, or a mark or member disposed on the upper surface of the upper end 52 of the side wall 5, could be used without departing from the broader aspects of the present invention.

In addition, although the cap 1*d*, shown in the drawings, is constructed with the aperture 15 disposed in the side wall 5 thereof, in the same manner as that shown in the cap 1, shown in FIG. 4, whereby the indicia, not shown, for indicating the relative positions of the housing 3*d* and 4 of the cap 1*d* are disposed on the outer face of the side wall 8 of the inner housing 4 thereof, in the same manner as that disclosed with respect to the cap 1, this is merely by way of illustration, and not by way of limitation with respect to the broader aspects of the present invention, and, if desired, the indicia could be located in other positions, such as, for example, on the top or upper surface of the inner housing 4, with a suitable indicator disposed on the top face of the upper end 52 of the side wall 5, without departing from the purview of the present invention.

From the foregoing it will be seen that the present invention affords a novel closure member of the "reminder-cap" type.

Also, it will be seen that if affords a novel closure member of the aforementioned type, which may be readily produced in such a manner as to afford effective protection against opening of a container by a small child.

In addition, it will be seen that the present invention affords a novel closure member of the aforementioned type which is practical and efficient in operation, and which may be readily and economically produced commercially.

Thus, while I have illustrated and described the preferred embodiments of my present invention, it is to be understood that these are capable of variation and modification, and I therefore do not wish to be limited to the precise details set forth, but desire to avail myself of such changes and alterations as fall within the purview of the following claims.

I claim:

1. A closure for a container, said closure comprising
a. an outer housing having
(1) an open bottom, and
(2) an aperture extending through a portion thereof,
b. an inner housing adapted to be mounted on such a container,
c. said inner housing
(2) being mounted in said outer housing in nested relation thereto,
(2) having
(a) an open bottom,
(b) a plurality of types of indicia disposed thereon, and
(3) being rotatable, relative to said outer housing, around the center axis of said last mentioned open bottom in a direction effective to pass said indicia past said aperture for viewing said indicia through said aperture from outside said outer housing,
d. a plurality of abutment members mounted on said inner housing, between said last mentioned open bottom and the top of said inner housing, and
e. another abutment member mounted in said outer housing in position to engage each of said first mentioned abutment members during said rotation of said inner housing in a manner effective to
(1) stop rotation of said inner and outer housings relative to each other in one direction around said axis, when said other abutment member is so engaged with one of said first mentioned abutment members, and
(2) yieldingly resist rotation of said inner and outer housings relative to each other in the direction opposite to said one direction around said axis, when said other abutment member is so engaged with one of said first mentioned abutment members,
f. said types of said indicia being so disposed on said inner housing that indicia of a respective one of said types is visible through said aperture when said other abutment member is disposed between a respective adjacent pair of said first mentioned abutment members.

2. A closure as defined in claim 1, and in which
a. said first mentioned abutment members comprise elongated ribs, and
b. said other abutment member comprises an elongated rib.

3. A closure member as defined in claim 1, and
a. which includes another housing, and
b. in which
(1) said outer housing has a plurality of additional abutments, and
(2) said other housing
(a) has an abutment,
(b) is mounted on said outer housing in nested relation thereto,
(c) has transparent wall portions for viewing said aperture therethrough, and
(d) is movable on said outer housing between
(1') one position wherein said last mentioned abutment is disposed in upwardly spaced relation to said additional abutments, and
(2') another position wherein said abutment of said outer housing is disposed in operative engagement with one of said additional abutments in position to apply rotation force to said outer housing in said one direction and said other direction relative to said inner housing, and
c. which includes means disposed between said outer housing and said other housing for yieldingly holding said other housing in said one position.

4. A closure member as defined in claim 1, and
a. which includes another housing, and
b. in which
(1) said other housing has a plurality of additional abutments, and
(2) said inner housing (a) has an abutment,
(b) is mounted on said other housing in nested relation thereto, and
(c) is movable on said other housing between
(1') one position wherein said last mentioned abutment is disposed in upwardly spaced relation to said additional abutments, and
(4') another position wherein said last mentioned abutment of said inner housing is disposed in operative engagement with one of said additional abutments in position to apply rotation force to said other housing in said one direction and said other direction, and c. which includes means disposed between said inner housing and said other housing for yieldingly holding said inner housing in said one position.

5. A closure as defined in claim 1, and in which
a. said outer housing includes means for movement into and out of engagement with such a container effective to hold said outer housing against rotation relative to such a container when said inner housing is so mounted on said container.

6. A closure as defined in claim 5, and in which
a. said container has a notch on the exterior thereof,
b. said means on said outer housing comprises a resilient finger
(1) depending below said open bottom of said outer housing, and
(2) movable laterally into and out of said notch.

7. In combination with a container having an open end for insertion of material into and removal of material from the container, said container having means for releasably holding a closure member thereon, a closure member comprising
a. two housings,
b. each of said housings
(1) comprising
(a) a top wall,
(b) a substantially cylindrical-shaped side wall depending from said top wall, and
(2) having an open bottom at the side of said side wall remote from said top wall,
c. one of said housings being disposed in the other of said housings in nested relation thereto, and with said side walls of said housings being disposed in substantially axially aligned, concentric relation to each other,
d. said housings being rotatable relative to each other around said axis of said side walls,
e. said other of said housings having a sight opening therethrough,
f. said one housing having a plurality of types of indicia spaced from each other thereon in such position that all of said indicia may be viewed through said sight opening from outside said other housing during a complete revolution of said housings relative to each other around said axis,
g. said one housing having a plurality of abutment members
(1) projecting substantially radially outwardly from said side wall thereof, and
(2) spaced from each other around said last mentioned side wall,
h. said other housing having another abutment member
(1) projecting substantially radially inwardly from said side wall thereof, and
(2) disposed in position to engage each of said first mentioned abutment members during said rotation of said housings relative to each other,
i. said plurality of abutment members and said other abutment member having
(1) faces engageable with each other, during rotation of said outer housing in one direction relative to said inner housing around said axis, in such a manner as to prevent further rotation of said outer housing relative to said inner housing in said one direction, and
(2) other faces engageable with each other, during rotation of said outer housing in the other direction relative to said inner housing around said axis, in such a manner as to yieldingly resist further rotation of said outer housing relative to said inner housing in said other direction,
j. said types of indicia being so disposed on said inner housing that indicia of a respective one of said types is visible through said aperture when said other abutment member is disposed between a respective adjacent pair of said first mentioned abutment members, and
k. means for operably engaging said means on such a container for thereby releasably holding said closure member on said container.

8. The combination defined in claim 7, and in which
a. said plurality of abutment members and said other abutment member comprise elongated ribs disposed in substantially parallel relation to said axis.

9. The combination defined in claim 7, and in which
a. said side wall of said other housing has an annular recess extending around the interior thereof, and
b. the end portion of said side wall of said one housing, remote from said top wall thereof, has an outwardly projecting annular flange
(1) extending therearound, and
(2) engaged in said recess for holding said two housings in said nested relation to each other.

10. The combination defined in claim 7, and
a. which includes a third housing
(1) mounted on said other housing, and
(2) movable relative to said other housing between
(a) one position wherein said third housing is operable, upon rotation thereof around said axis, to rotate said other housing around said axis, and
(b) another position wherein said third housing is freely rotatable around said axis, relative to said other housing.

11. The combination defined in claim 7, and
a. which includes a third housing mounted in said one housing, and
b. in which said one housing is movable relative to said third housing between
(1) one position wherein said one housing is operable, upon rotation thereof around said axis, to rotate said third housing around said axis, and
(2) another position wherein said one housing is freely rotatable, around said axis, relative to said third housing.

12. The combination defined in claim 7, and in which
a. said container includes an outwardly projecting flange having notches spaced around the outer periphery thereof, and
b. said other housing includes resilient means
(1) depending therefrom, and
(2) movable (a) into respective ones of said notches for holding said other housing against rotation, around said axis, relative to said container, and (b) away from said recesses for freeing said other housing for rotation, around said axis, relative to said container.

13. A closure for a container, said closure comprising a. an outer housing having (1) an open bottom, and (2) a side wall extending upwardly from said open bottom and having an indicating portion, b. an inner housing adapted to be mounted on such a container, c. said inner housing (1) being mounted in said outer housing in nested relation thereto, (2) having (a) an open bottom, (b) a plurality of types of indicia disposed thereon, and (3) being rotatable, relative to said outer housing, around the center axis of said last mentioned open bottom in a direction effective to pass said indicia past said indicating portion in position to show the position of said indicia relative to said indicating portion from outside said outer housing, d. a plurality of abutment members mounted on said inner housing, between said last mentioned open bottom and the top of said inner housing, and e. another abutment member mounted in said outer housing in position to engage each of said first mentioned abutment members during said rotation of said inner housing in a manner effective to (1) stop rotation of said inner and outer housings relative to each other in one direction around said axis, when said other abutment member is so engaged with one of said first mentioned abutment member, and (2) yieldingly resist rotation of said inner and outer housings relative to each other in the direction opposite to said one direction around said axis, when said other abutment member is so engaged with one of said first mentioned abutment members, f. said types of said indicia being so disposed on said inner housing that indicia of a respective one of said types is disposed adjacent to said indicating portion when said other abutment member is disposed between a respective adjacent pair of said first mentioned abutment members.

14. A closure as defined in claim 13, and in which a. said side wall of said outer housing is substantially cylindrical in shape, b. said inner housing comprises (1) a substantially cylindrical-shaped side wall disposed in said first mentioned side wall in substantially co-axial relation thereto, (2) a top wall extending across the end of said side wall of said inner housing remote from said open end of the latter in closing relation to said end of said last mentioned side wall, and c. the opposite ends of said side wall of said outer housing are disposed in substantially uniplanar relation to the outer face of said top wall and to said open bottom of said inner housing respectively.

15. A closure member as defined in claim 14, and in which a. said indicating portion comprises an aperture in said side wall of said outer housing for viewing the outside of said side wall of said inner housing from outside said outer housing, and b. said indicia is disposed on the outside of said side wall of said inner housing through said aperture from outside said outer housing.

* * * * *